US005781955A

United States Patent [19]

Hendricks

[11] Patent Number: 5,781,955

[45] Date of Patent: Jul. 21, 1998

[54] MOTORIZED MULTIPLE BRUSH ASSEMBLY

[76] Inventor: Glen J. Hendricks, 227 S. Clinton St., East Orange, N.J. 07018

[21] Appl. No.: 729,999

[22] Filed: Oct. 11, 1996

[51] Int. Cl.[6] ..... A46B 13/02

[52] U.S. Cl. ..... 15/22.1

[58] Field of Search ..... 15/22.1, 23, 28; 30/277.4

[56] References Cited

U.S. PATENT DOCUMENTS

| | | | |
|---|---|---|---|
| 3,802,420 | 4/1974 | Moffat | 15/28 |
| 3,890,984 | 6/1975 | Lesetar | 15/23 |
| 3,987,549 | 10/1976 | Robertelli | 15/23 |
| 5,235,716 | 8/1993 | Stella | 15/23 |
| 5,269,104 | 12/1993 | DiBiagio | 15/23 |
| 5,353,461 | 10/1994 | Enriquez | 15/23 |
| 5,423,102 | 6/1995 | Madison | 15/28 |
| 5,511,269 | 4/1996 | Watson | 15/28 |

FOREIGN PATENT DOCUMENTS

| | | | |
|---|---|---|---|
| 651108 | 10/1928 | France | 15/23 |
| 816621 | 10/1951 | Germany | 15/23 |

*Primary Examiner*—Randall Chin

[57] ABSTRACT

A motorized multiple brush assembly including a handle having a top circular face, a bottom circular face, and a periphery formed therebetween, wherein the handle has a rotating rod concentrically situated along the length thereof with ends protruding therefrom. Further provided is a plurality of attachments adapted to be releasably coupled to the rotating rod. The attachments include a saw attachment with a disk-shaped rigid saw concentrically coupled thereto, a first brush attachment with a brush having a triangular configuration concentrically coupled thereto, a second brush attachment with the brush having a generally cylindrical configuration concentrically coupled thereto, and a third brush attachment with the brush having a disc shaped configuration concentrically coupled thereto. Finally, a control system is situated within the handle and powered by a battery. In use, the control system is adapted to actuate the rotating rod of the handle in a first direction upon the depression of an actuator button positioned on the handle.

8 Claims, 3 Drawing Sheets

Synchronous Variable Machine

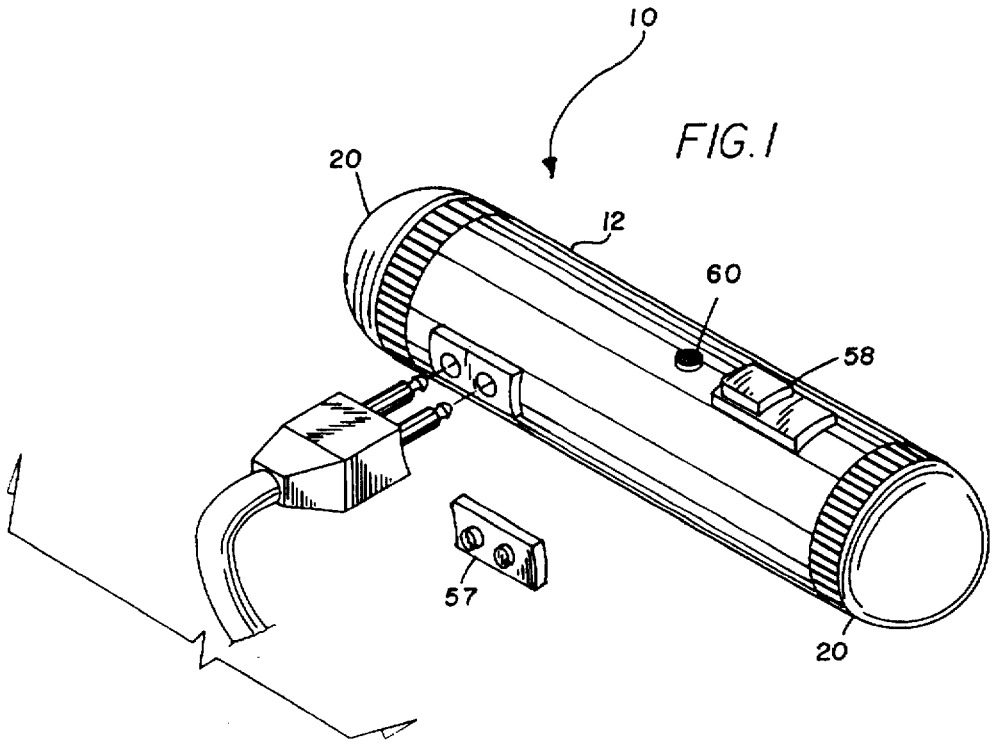
FIG. 1
FIG. 2
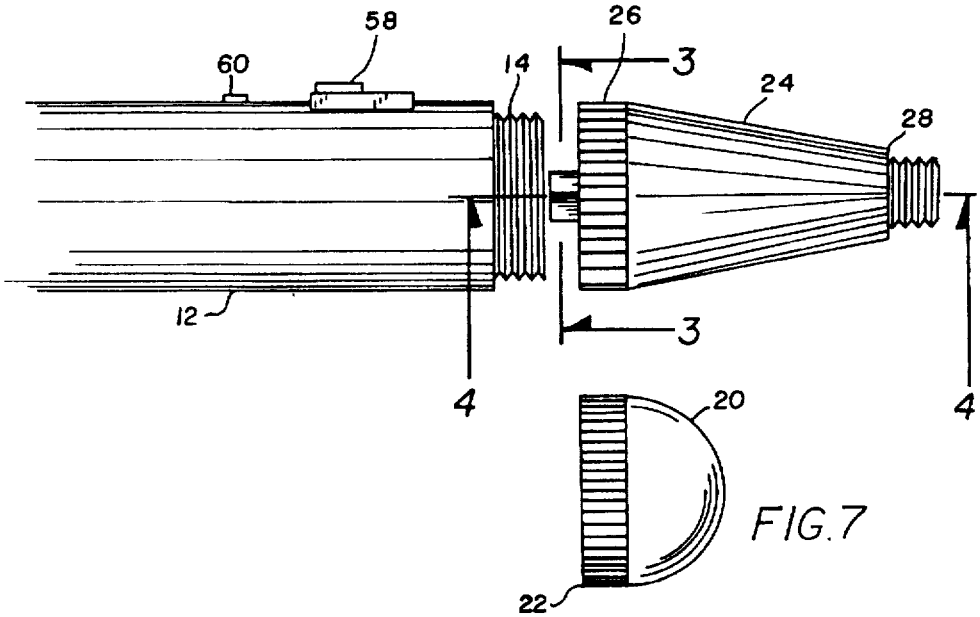
FIG. 7

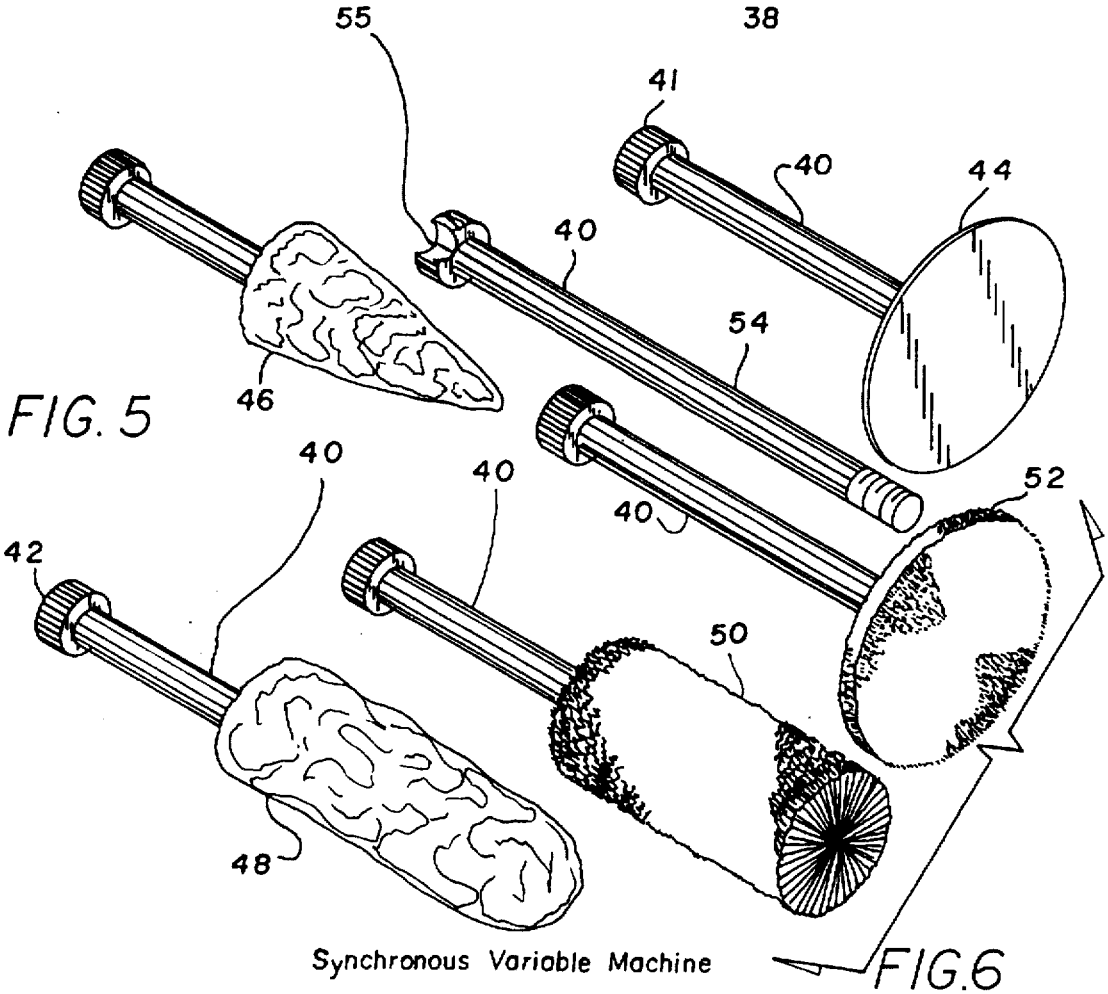
FIG. 5
FIG. 6
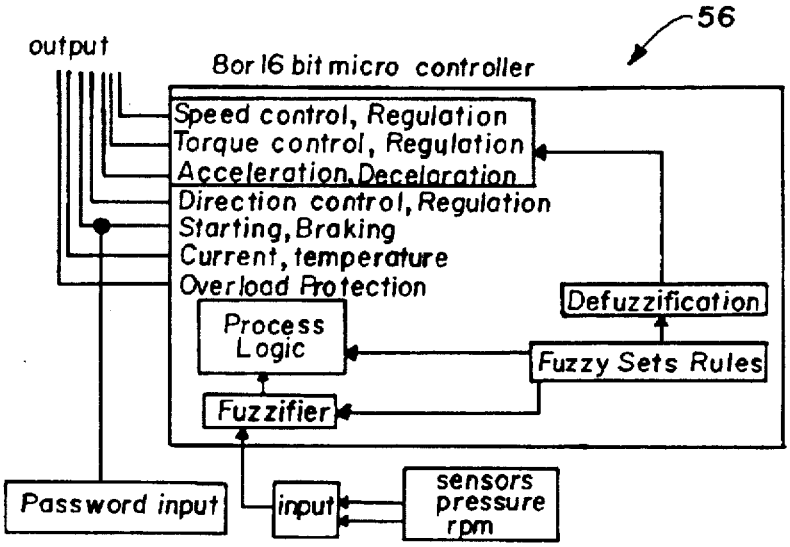

MOTORIZED MULTIPLE BRUSH ASSEMBLY

BACKGROUND OF THE INVENTION

1. Field of the Invention

The present invention relates to motorized multiple brush assembly and more particularly pertains to utilizing a multiple brush system for accomplishing various tasks.

2. Description of the Prior Art

The use of motorized brush systems is known in the prior art. More specifically, motorized brush systems heretofore devised and utilized for the purpose of accomplishing a sole cleaning task are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,158,246 to Meadows et al.; U.S. Pat. No. 4,137,589 to Sukhraj; U.S. Pat. No. Des. 321,988 to Fedora; U.S. Pat. No. 4,476,602 to Hurn et al.; U.S. Pat. No. 4,202,067 to Stamatovic; and U.S. Pat. No. 4,930,240 to Bice.

In this respect, the motorized multiple brush assembly according to the present invention substantially departs from the conventional concepts and designs of the prior art, and in so doing provides an apparatus primarily developed for the purpose of utilizing a multiple brush system for accomplishing various tasks and further providing a plurality of features for the same.

Therefore, it can be appreciated that there exists a continuing need for a new and improved motorized multiple brush assembly which can be used for utilizing a multiple brush system for accomplishing various tasks. In this regard, the present invention substantially fulfills this need.

SUMMARY OF THE INVENTION

In view of the foregoing disadvantages inherent in the known types of motorized brush systems now present in the prior art, the present invention provides an improved motorized multiple brush assembly. As such, the general purpose of the present invention, which will be described subsequently in greater detail, is to provide a new and improved motorized multiple brush assembly which has all the advantages of the prior art and none of the disadvantages.

To attain this, the present invention essentially comprises a water resistant handle with a cylindrical configuration. As such, the handle has a top circular face, a bottom circular face, and a periphery formed therebetween. As shown in FIG. 2, the periphery of the housing is lined with threaded concentric grooves adjacent the top face and the bottom face thereof. The handle further has a rotating rod concentrically situated along the length thereof with ends protruding from the top face and the bottom face. Each end has a hexagonal slot formed therein. As best shown in FIG. 4, at least one adapter cap is included. Each adapter cap has a generally frusto-conical configuration with a circular inboard end and an outboard end. The adapter cap is lined at the inboard end thereof with threaded concentric grooves for allowing the removable coupling thereof with the grooves of the top face and bottom face of the handle. The adapter cap further includes a connecting post rotatably situated concentrically within the adapter cap with a first end protruding from the inboard end of the adapter cap and formed with a hexagonal cross section. The inboard end is adapted for engaging the hexagonal slot of the ends of the rotating rod of the handle upon engaging the threaded grooves of the inboard end of the adapter cap with those of the handle. The connecting post of the adapter cap further has a second end protruding from the outboard end thereof and lined with threaded concentric grooves. The second end of the connecting rod has a hexagonal slot formed therein. It should be noted that the post is precluded from translating along the central axis of the adapter cap. For allowing the use of the present invention for various tasks, a plurality of attachments are provided. Each attachment includes a bar with a first end having a couple rotatably attached thereto and lined with threaded grooves. The first end further has a hexagonal cross section for engaging the hexagonal slot of the outboard end of the adapter cap upon the screwable coupling between the threaded grooves of the outboard end of the adapter cap and those of the couple. The attachments include a saw attachment with a disk-shaped rigid saw concentrically coupled to a second end of the bar, a first brush attachment with a brush having a triangular configuration concentrically coupled to a second end of the bar, a second brush attachment with the brush having a generally cylindrical configuration concentrically coupled to a second end of the bar, and a third brush attachment with the brush having a disc shaped configuration concentrically coupled to a second end of the bar. Finally, a control system is situated within the handle and powered by a battery. The control system is adapted to actuate the rotating rod of the handle in a first direction upon the successive depression of an actuator button positioned on the handle. To actuate the rotating rod of the handle in a second direction, a reverse button is also positioned on the handle. In use, the reverse button may be depressed after actuation of the rod. The control system is further adapted to adjust the torque which the rotating rod delivers in response to a present load. Lastly, the control system is adapted to deactivate the rotating rod after a change in the load is not detected after a predetermined amount of time.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved motorized multiple brush assembly which has all the advantages of the prior art motorized brush systems and none of the disadvantages.

It is another object of the present invention to provide a new and improved motorized multiple brush assembly which may be easily and efficiently manufactured and marketed.

It is a further object of the present invention to provide a new and improved motorized multiple brush assembly which is of a durable and reliable construction.

An even further object of the present invention is to provide a new and improved motorized multiple brush assembly which is susceptible of a low cost of manufacture with regard to both materials and labor, and which accordingly is then susceptible of low prices of sale to the consuming public, thereby making such motorized multiple brush assembly economically available to the buying public.

Still yet another object of the present invention is to provide a new and improved motorized multiple brush assembly which provides in the apparatuses and methods of the prior art some of the advantages thereof, while simultaneously overcoming some of the disadvantages normally associated therewith.

Still another object of the present invention is to utilize a multiple brush system for accomplishing various tasks.

Lastly, it is an object of the present invention to provide a new and improved motorized multiple brush assembly including a handle having a top circular face, a bottom circular face, and a periphery formed therebetween, wherein the handle has a rotating rod concentrically situated along the length thereof with ends protruding therefrom. Further provided is a plurality of attachments adapted to be releasably coupled to the rotating rod. The attachments include a saw attachment with a disk-shaped rigid saw concentrically coupled thereto, a first brush attachment with a brush having a triangular configuration concentrically coupled thereto, a second brush attachment with the brush having a generally cylindrical configuration concentrically coupled thereto, and a third brush attachment with the brush having a disc shaped configuration concentrically coupled thereto. Finally, a control system is situated within the handle and powered by a battery. In use, the control system is adapted to actuate the rotating rod of the handle in a first direction upon the depression of an actuator button positioned on the handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the motorized multiple brush assembly constructed in accordance with the principles of the present invention.

FIG. 2 is a close-up side view of the present invention.

FIG. 5 is a perspective view of the plurality of various attachments adapted to be utilized with the present invention.

FIG. 6 is a flow chart depicting the various functions which the present invention is capable of by means of the control system thereof.

FIG. 7 is a side view of one of the storage caps of the present invention.

Similar reference characters refer to similar parts throughout the several views of the drawings.

DESCRIPTION OF THE PREFERRED EMBODIMENT

Figure 3:
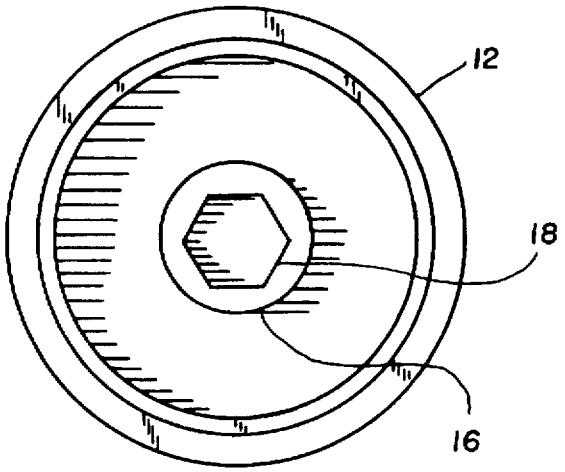
FIG. 3 is a top plan view of the top face of the handle of the present invention.

With reference now to the drawings, and in particular to FIG. 1 thereof, a new and improved motorized multiple brush assembly embodying the principles and concepts of the present invention and generally designated by the reference numeral 10 will be described.

The present invention, the new and improved motorized multiple brush assembly, is comprised of a plurality of components. Such components in their broadest context include a handle, a pair of storage caps, an adapter cap, a plurality of attachments. Such components are individually configured and correlated with respect to each other so as to attain the desired objective.

More specifically, it will be noted that the system 10 of the present invention includes a water resistant handle 12 with a cylindrical configuration. As such, the handle 12 has a top circular face, a bottom circular face, and a periphery formed therebetween. Ideally, the handle is approximately 8 inches in length and 1 and ½ inches in width. As shown in FIG. 2, the periphery of the housing is lined with threaded concentric grooves 14 adjacent the top face and the bottom face thereof. The handle further has a rotating rod 16 concentrically situated along the length thereof with ends protruding from the top face and the bottom face. Each end has a hexagonal slot 18 formed therein.

For covering the top and bottom face of the handle during storage, a pair of storage caps 20 are included. See FIG. 7. Each cap has a semi-spherical configuration with an open planar bottom. To allow the removable coupling of the caps with the handle, each of the caps are lined on an interior surface thereof with threaded concentric grooves 22 adjacent the bottom thereof. Each cap is also lined with a bushing along the bottom thereof for precluding water from penetrating the handle.

Figure 4:
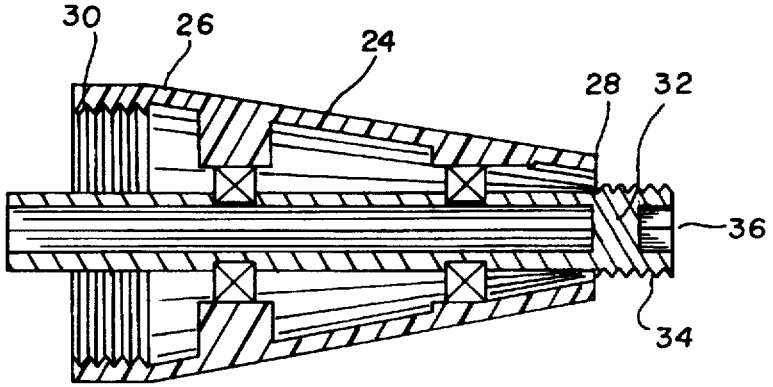
FIG. 4 is a cross-sectional view of the present invention taken along line 4—4 shown in FIG. 2.

As best shown in FIG. 4, at least one adapter cap 24 is included. Each adapter cap has a generally frusto-conical configuration with a circular inboard end 26 and an outboard end 28. The adapter cap is lined at the inboard end thereof with threaded concentric grooves 30 for allowing the removable coupling thereof with the grooves of the top face and bottom face of the handle. The adapter cap further includes a connecting post 32 rotatably situated concentrically within the adapter cap with a first end protruding from the inboard end of the adapter cap and formed with a hexagonal cross section. The inboard end is adapted for engaging the hexagonal slot of the ends of the rotating rod of the handle upon engaging the threaded grooves of the inboard end of the adapter cap with those of the handle. The connecting post of the adapter cap further has a second end protruding from the outboard end thereof and lined with threaded concentric grooves 34. The second end of the connecting post has a hexagonal slot 36 formed therein. It should be noted that the post is precluded from translating along the central axis of the adapter cap.

For allowing the use of the present invention for various tasks, a plurality of attachments 38 are provided. Each attachment includes a bar 40 with a first end having a couple 41 rotatably attached thereto and lined with threaded grooves 42. The first end further has a hexagonal cross section for engaging the hexagonal slot of the outboard end of the adapter cap upon the screwable coupling between the threaded grooves of the outboard end of the adapter cap and those of the couple. The attachments include a saw attachment 44 with a disk-shaped rigid saw concentrically coupled to a second end of the bar. A first brush-attachment 46 is included with a brush having a triangular configuration concentrically coupled to a second end of the bar. Such brush attachment is formed of a soft cloth-type material. A second brush attachment 48 is included with the brush having a generally cylindrical configuration concentrically coupled to a second end of the bar. A similar brush attachment 50 is also included but with bristles fixed at a second end thereof and extending radially outwardly therefrom. Further provided is a third brush attachment 52 with a brush having a disk-shaped configuration concentrically coupled to a second end of the bar.

For utilizing the various attachments in remote, hard to reach areas, an extension bar 54 is included. See FIG. 5. Similar to the foregoing attachments, the extension bar has an inboard end with a couple rotatably coupled thereto and lined with threaded grooves. For engaging the hexagonal slot of the outboard end of the adapter cap upon the screwable coupling between the threaded grooves of the outboard end of the adapter cap and those of the couple, the inboard end of the extension bar further has a hexagonal cross section. The extension bar is also provided with an outboard end lined with threaded concentric grooves and a hexagonal slot 55 formed therein. By this structure, the second end of the extension bar is adapted to be coupled with the attachments.

Finally, a control system 56 is situated within the handle and powered by a battery. Such battery is rechargeable by connecting the present invention to an AC receptacle via a socket formed in the periphery of the handle. A plug cap 57 is included for sealing the socket in use. The control system is adapted to actuate the rotating rod of the handle in a first direction upon the successive depression of an actuator button 58 positioned on the handle in a predetermined sequence. Such sequence resembles MORSE CODE and prevents unauthorized usage of the present invention by children. To actuate the rotating rod of the handle in a second direction, a reverse button 60 is also positioned on the handle. In use, the reverse button may be depressed after actuation of the rod to effect opposite rotation. The control system is further adapted to adjust the torque which the rotating rod delivers in response to a present load. Lastly, the control system is adapted to deactivate the rotating rod after a change in the load is not detected after a predetermined amount of time.

To accomplish its intended function, the control system employs RPM sensors which provide feedback for controlling the speed and corresponding torque delivered. As such, the present invention may be utilized for different purposes which require various torques and speeds. Heat sensors may also be employed for accomplishing the same. A timer is employed to accomplish the automatic deactivation capabilities of the present invention. Preferably, a 8 or 16-bit micro-controller or fuzzy logic micro-controller is networked between the above components, RAM, and an INTEL 486 processor to ensure proper logic operation. It should be noted that the micro-controller is a fully embedded system that is capable of communicating with other hardware while using state of the art Fuzzy Logic technology thereby allowing sensor input.

The present invention may be utilized for the purpose of cleaning cars, scrubbing pots and pans, removing mildew and mold from bathroom tiles, polishing shoes, and cutting small branches.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A motorized multiple brush assembly comprising, in combination:

a water resistant handle with a cylindrical configuration having a top circular face, a bottom circular face, and a periphery formed therebetween, the periphery being lined with threaded concentric grooves adjacent the top face and the bottom face, the handle further having a rotating rod concentrically situated along the length thereof with ends protruding from the top face and the bottom face, each end having a hexagonal slot formed therein;

a plurality of storage caps each having a semi-spherical configuration with an open planar bottom, wherein the caps are lined on an interior surface thereof with threaded concentric grooves adjacent the bottom thereof for allowing the removable coupling thereof with the grooves of the top face and the bottom face of the handle during storage;

at least one adapter cap with a generally frusto-conical configuration having a circular inboard end and an outboard end, the adapter cap being lined at the inboard end thereof with threaded concentric grooves for allowing the removable coupling thereof with the grooves of the top face and the bottom face of the handle, the adapter cap further including a connecting post rotatably situated concentrically within the adapter cap with a first end protruding from the inboard end of the adapter cap and formed with a hexagonal cross section for engaging the hexagonal slot of the ends of the rotating rod of the handle upon engaging the threaded grooves of the inboard end of the adapter cap with those of the handle, the connecting post of the adapter cap further having a second end protruding from the outboard end thereof and further lined with threaded concentric grooves, the second end of the connecting post also having a hexagonal slot formed therein, wherein the connecting post is precluded from translating along a central axis of the adapter cap;

a plurality of attachments each including a bar with a first end having a couple rotatably attached thereto and lined with threaded grooves, the first end further having a hexagonal cross section for engaging the hexagonal slot of the outboard end of the adapter cap upon the screwable coupling between the threaded grooves of the outboard end of the adapter cap and those of the couple, the attachments including a saw attachment with a disk-shaped rigid saw concentrically coupled to a second end of the bar, a first brush attachment with a brush having a triangular configuration concentrically coupled to a second end of the bar, a second brush attachment with the brush having a generally cylindrical configuration concentrically coupled to a second end of the bar, and a third brush attachment with the brush having a disc shaped configuration and concentrically coupled to a second end of the bar;

an extension bar having an inboard end with a couple rotatably coupled thereto and lined with threaded grooves, the inboard end of the extension bar further having a hexagonal cross section for engaging the hexagonal slot of the outboard end of the adapter cap upon the screwable coupling between the threaded grooves of the outboard end of the adapter cap and those of the couple, the extension bar having an outboard end lined with threaded concentric grooves and having a hexagonal slot formed therein for allowing the optional coupling thereof with the first end of the attachments for utilizing the attachments at a greater distance from the handle;

a battery for powering purposes;

an actuator button capable of being depressed;

a reverse button capable of being depressed; and a control system situated within the handle and powered by the battery, the control system adapted to actuate the rotating rod of the handle in a first direction upon the successive depression of the actuator button positioned on the handle, to actuate the rotating rod of the handle in a second direction upon the depression of the reverse button also positioned on the handle after actuation of the rod, to adjust the torque which the rotating rod delivers in response to a present load, and to deactivate the rotating rod after a change in the load is not detected after a predetermined amount of time.

2. A motorized multiple brush assembly comprising:

a handle having a top circular face, a bottom circular face, and a periphery formed therebetween, wherein the handle has a rotating rod with ends concentrically situated along a length of the handle with the ends of the rod protruding from the handle;

a plurality of attachments adapted to be releasably coupled to the rotating rod of the handle, the attachments including a saw attachment with a disk-shaped rigid saw concentrically coupled thereto, a first brush attachment with a brush having a triangular configuration concentrically coupled thereto, a second brush attachment with the brush having a generally cylindrical configuration concentrically coupled thereto, and a third brush attachment with the brush having a disc shaped configuration concentrically coupled thereto;

a battery for powering purposes;

an actuator button capable of being depressed; and a control system situated within the handle and powered by the battery, the control system adapted to actuate the rotating rod of the handle in a first direction upon the depression of the actuator button positioned on the handle.

3. A motorized multiple brush assembly as set forth in claim 2 wherein a reverse button is included which may be depressed and the control system is further adapted to actuate the rotating rod of the handle in a second direction upon the depression of the reverse button also positioned on the handle after actuation of the rod.

4. A motorized multiple brush assembly as set forth in claim 2 wherein the control system is further adapted to adjust the torque which the rotating rod delivers in response to a present load.

5. A motorized multiple brush assembly as set forth in claim 2 wherein the control system is further adapted to deactivate the rotating rod after a change in the load is not detected after a predetermined amount of time.

6. A motorized multiple brush assembly as set forth in claim 2 and further including at least one adapter cap with a generally frusto-conical configuration having a circular inboard end and an outboard end, the adapter cap adapted to allow the removable coupling thereof with the handle, the adapter cap further including a connecting post rotatably situated concentrically within the adapter cap.

7. A motorized multiple brush assembly as set forth in claim 2 and further including an extension bar for utilizing the attachments at a greater distance from the handle.

8. A motorized multiple brush assembly as set forth in claim 2 and further including a plurality of storage caps each having a semi-spherical configuration with an open planar bottom, wherein the caps are adapted to be removably coupled with the top face and the bottom face of the handle during storage.

* * * * *